US010619639B2

(12) United States Patent
Li et al.

(10) Patent No.: US 10,619,639 B2
(45) Date of Patent: Apr. 14, 2020

(54) MOTOR AND FLUID DELIVERY DEVICE COMPRISING SAME

(71) Applicant: Johnson Electric S.A., Murten (CH)

(72) Inventors: Yue Li, Hong Kong (CN); Mao Xiong Jiang, Shenzhen (CN); Ke Lin Zhou, Shenzhen (CN); Jian Zhao, Shen Zhen (CN); Yong Li, Shen Zhen (CN); Yong Wang, Shen Zhen (CN)

(73) Assignee: JOHNSON ELECTRIC INTERNATIONAL AG, Murten (CH)

( * ) Notice: Subject to any disclaimer, the term of this patent is extended or adjusted under 35 U.S.C. 154(b) by 267 days.

(21) Appl. No.: 15/604,087

(22) Filed: May 24, 2017

(65) Prior Publication Data

US 2017/0342987 A1 Nov. 30, 2017

(30) Foreign Application Priority Data

May 24, 2016 (CN) ..... 2016 1 0349990

(51) Int. Cl.

| | |
|---|---|
| ***F04D 25/06*** | (2006.01) |
| ***F04D 29/66*** | (2006.01) |
| ***F04D 13/06*** | (2006.01) |
| ***F04D 17/16*** | (2006.01) |
| ***F04D 29/24*** | (2006.01) |

(52) U.S. Cl.

CPC ..... *F04D 13/06* (2013.01); *F04D 17/16* (2013.01); *F04D 25/0646* (2013.01); *F04D 29/24* (2013.01); *F04D 29/66* (2013.01)

(58) Field of Classification Search

CPC ..... H02K 1/18; H02K 1/187; H02K 5/15; H02K 15/028; F04D 25/0646; F04D 29/66

USPC ..... 310/51, 422–423, 254.1

See application file for complete search history.

(56) References Cited

U.S. PATENT DOCUMENTS

| | | | | |
|---|---|---|---|---|
| 3,693,035 | A * | 9/1972 | Ostwald | H02K 1/185 310/51 |
| 5,027,026 | A * | 6/1991 | Mineta | H02K 1/187 310/216.127 |
| 7,659,645 | B2 * | 2/2010 | Bi | F16F 15/08 310/216.124 |
| 10,135,313 | B2 * | 11/2018 | Jang | H02K 1/146 |
| 10,381,891 | B2 * | 8/2019 | Jang | D06F 37/20 |
| 2016/0363125 | A1 * | 12/2016 | Chien | F04D 25/0633 |

FOREIGN PATENT DOCUMENTS

| | | |
|---|---|---|
| CN | 203374569 U | 1/2014 |

* cited by examiner

*Primary Examiner* — Jeremy A Luks

(74) *Attorney, Agent, or Firm* — Muncy, Geissler, Olds & Lowe, P.C.

(57) ABSTRACT

A motor includes a housing, a stator and a rotor. The stator is disposed in the housing. The rotor is rotatably supported on the stator. The motor further includes a shock absorbing member and a fastener. The fastener extends through the shock absorbing member and the stator, and the fastener is fixedly connected to the housing. The motor of the present invention operates with low noise. The present invention further provides a fluid delivery device using the motor.

18 Claims, 7 Drawing Sheets

MOTOR AND FLUID DELIVERY DEVICE COMPRISING SAME

CROSS REFERENCE TO RELATED APPLICATIONS

This non-provisional patent application claims priority under 35 U.S.C. § 119(a) from Patent Application No. 201610349990.9 filed in The People's Republic of China on May 24, 2016.

FIELD OF THE INVENTION

The present invention relates to motors, and in particular to a motor with reduced noise and a fluid delivery device including the motor.

BACKGROUND OF THE INVENTION

A motor is an electromagnetic device which realizes electric energy conversion or transmission according to the law of electromagnetic induction. A main function of the motor is to produce driving torque and acts as a power source for electric appliances or various machinery. However, when a rotor of the motor rotates at a high speed, vibration is generated which may be transmitted to a motor housing via a motor stator, thus resulting in large noise.

SUMMARY OF THE INVENTION

Thus, there is a desire for a motor with reduced vibration and noise, and a fluid delivery device including the motor.

In one aspect, a motor includes a housing, a stator and a rotor. The stator is disposed in the housing. The rotor is rotatably supported on the stator. The motor further includes a shock absorbing member and a fastener. The fastener extends through the stator and fastened to the housing. The shock absorbing member is mounted to the stator and engaged between the fastener and the stator, thereby present the fastener from directly contacting the stator.

Preferably, the shock absorbing member comprises a an accommodating portion is defined in the stator, and the shock absorbing member is received in the accommodating portion, the fastener extending through the shock absorbing member.

Preferably, the shock absorbing member comprises a first shock absorbing body and a second shock absorbing body, the first shock absorbing body and the second absorbing body are configured to be engaged into the accommodating portion from opposite ends of the accommodating portion.

Preferably, the first shock absorbing body comprises a main portion and a flange portion formed at an end of the main portion, the main portion of the first shock absorbing body are engaged in the accommodating portion, the flange portion of the first shock absorbing body extends out of the accommodating portion, the fastener extends through the flange portion of the first shock absorbing body and the main portion of the first shock absorbing body.

Preferably, the second shock absorbing body comprises a main portion and a flange portion formed at an end of the main portion, the main portion of the second shock absorbing body are engaged in the accommodating portion, the flange portion of the second shock absorbing body extends out of the accommodating portion, and the stator is sandwiched between the flange portion of the first shock absorbing body and the flange portion of the second shock absorbing body, the fastener extends through the flange portion of the second shock absorbing body and the main portion of the second shock absorbing body.

Preferably, the first shock absorbing body and the second shock absorbing body are integrally formed or separately formed.

Preferably, the stator comprises a bobbin and a stator core supported by the bobbin, the accommodating portion is a through hole defined in the bobbin.

Preferably, the stator comprises a bobbin and a stator core detachably mounted to the bobbin, the accommodating portion is a groove extending through the bobbin adjacent a lateral surface of the stator core.

Preferably, the bobbin comprises a central positioning portion and a supporting portion fixedly attached around the central positioning portion, the stator core is fixed by the supporting portion and the accommodating portion is defined in the supporting portion.

Preferably, the rotor comprises a main shaft and a rotor assembly, the main shaft is rotatably supported on the first supporting portion, the rotor assembly is fixedly sleeved on the main shaft and rotatably disposed around the stator core with a clearance kept between the inner surface of the rotor assembly and the stator core.

Preferably, the rotor assembly comprises a casing and a plurality of magnets mounted to the casing, the casing comprises a first connection portion and a second connection portion connected with the first connection portion, the magnets are mounted to an inner surface of the second connection portion, the first connection portion is fixedly attached around the main shaft above the stator, and the second connection portion is disposed around the stator core.

Preferably, a first guiding portion is formed on an inner surface of the accommodating portion, a second guiding portion is provided on a lateral surface of the shock absorbing member, configured to mate with the first guiding portion.

Preferably, a lateral surface of the shock absorbing member fits an inner surface of the accommodating portion.

Preferably, the fastener comprises a rod body and a fastening head protruding from one end of the rod body, the rod body extends through the shock absorbing member and the stator to fixedly connect to the housing, and the fastening head is disposed adjacent one end of the shock absorbing member away from the housing.

Preferably, wherein the motor further comprises a washer, the washer is disposed between the shock absorbing member and the housing, a shaft shoulder is provided on the rod body, the rod body extends through the washer, and the washer abuts against the shaft shoulder.

Preferably, a mounting hole is defined in the housing, the mounting hole comprises a first mounting portion and a second mounting portion in communication with the first mounting portion, the first mounting portion has a diameter less than that of the second mounting portion, the second mounting portion is disposed adjacent the stator, and the washer is received in the second mounting portion.

Preferably, a depression is defined in one side of the housing, the stator and the rotor are received in the depression, and the mounting hole is defined in a bottom portion of the depression.

Preferably, the housing further comprises a support post, the support post protrudes from an opposite side of the housing and corresponds to the mounting hole, and the mounting hole extends through the support post.

Preferably, said at least one shock absorbing member comprises two or more shock absorbing members, said at least one fastener comprises two or more fasteners, the number of the fasteners is equal to the number of the shock absorbing members, the washer comprises two or more position-limiting portions, the number of the position-limiting portions is equal to the number of the shock absorbing members, and each fastener extends through one of the position-limiting portions.

Preferably, the washer is C-shaped, the washer further comprises fixed connection portions, and each of the fixed connection portions connect two adjacent position-limiting portions.

Preferably, the shock absorbing member is made of one of rubber, resin and foam.

In another aspect, a fluid delivery device includes the motor described above and an impeller. A rotor of the motor is non-rotatably connected to the impeller.

In the motor and fluid delivery device of the present invention, the shock absorbing member is disposed in the stator, the fastener extends in the shock absorbing member, such that the vibrations caused by rotation of the motor are partially absorbed by the shock absorbing member and partially transmitted via the fastener to the housing and hence to be absorbed by the housing, thereby reducing the noise generated by the motor during operation.

Below, embodiments of the present invention will be described in detail with reference to the accompanying drawings.

DETAILED DESCRIPTION OF THE PREFERRED EMBODIMENTS

The technical solutions of the embodiments of the present invention will be clearly and completely described as follows with reference to the accompanying drawings. Apparently, the embodiments as described below are merely part of, rather than all, embodiments of the present invention. Based on the embodiments of the present invention, any other embodiment obtained by a person skilled in the art without paying any creative effort shall fall within the protection scope of the present invention.

It is noted that, when a component is described to be "connected" to another component, it can be directly connected to the another component or there may be an intermediate component. When a component is described to be "disposed" on another component, it can be directly disposed on the another component or there may be an intermediate component. The term "housing" or similar expressions used in this disclosure are for the purposes of illustration only.

Unless otherwise specified, all technical and scientific terms have the ordinary meaning as commonly understood by people skilled in the art. The terms used in this disclosure are illustrative rather than limiting. The term "and/or" used in this disclosure means that each and every combination of one or more associated items listed are included.

Figure 1:
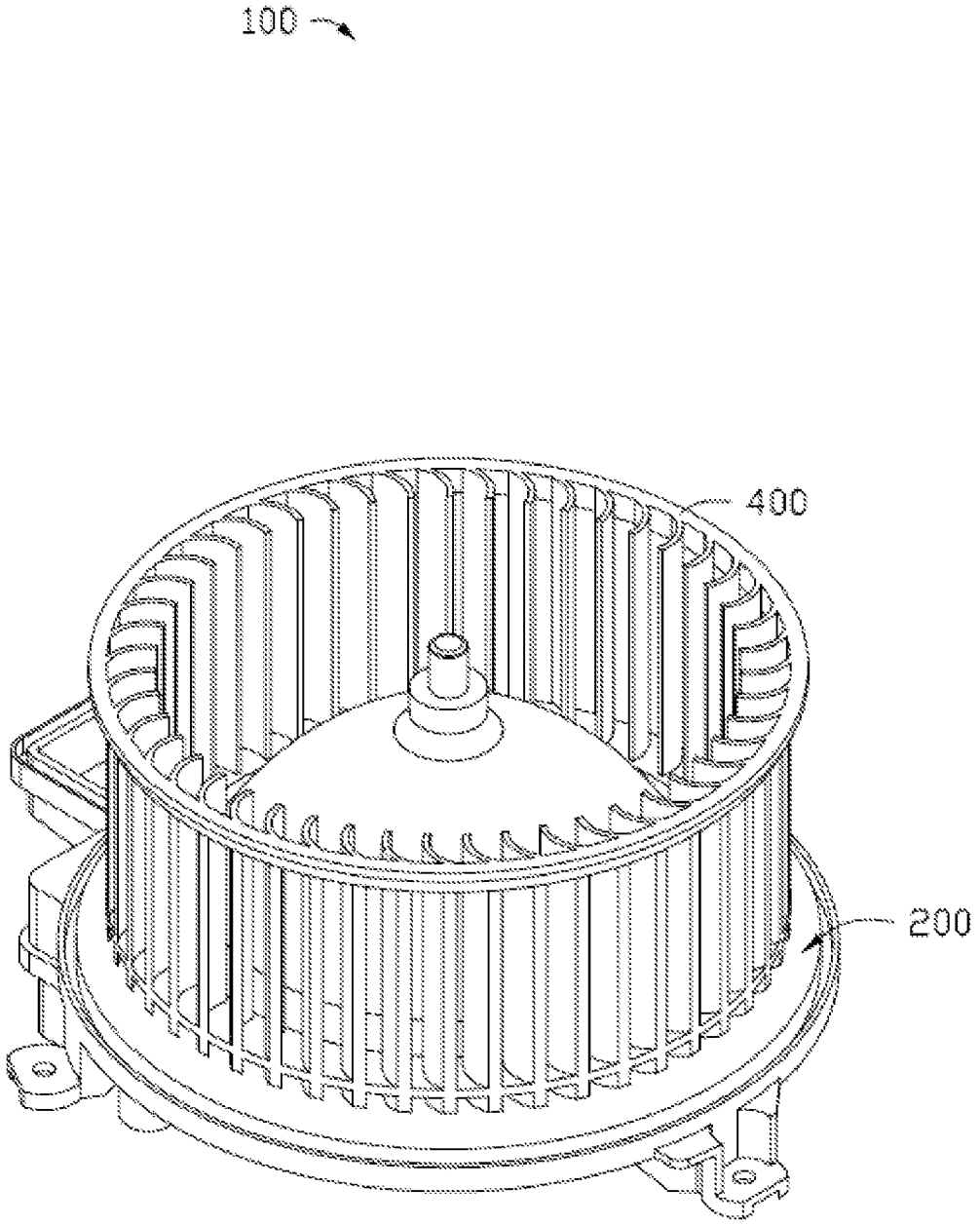
FIG. 1 is a perspective view of a fluid delivery device according to a first embodiment of the present invention.

Referring to FIG. 1, a fluid delivery device 100 according to a first embodiment of the present invention includes a motor 200 and an impeller 400. The fluid delivery device 100 may be used to pump a fluid such as gas, water and oil. In this embodiment, the fluid delivery device 100 is a blower. In other embodiments, the fluid delivery device 100 may be a liquid pump or another fluid delivery device. The impeller 400 is fixed to one end of the motor 200, and is driven by the motor 200. It should be understood that the fluid delivery device 100 further includes other components such as a diffuser (not shown), which are not described in details herein for reducing length of this disclosure.

Figure 2:
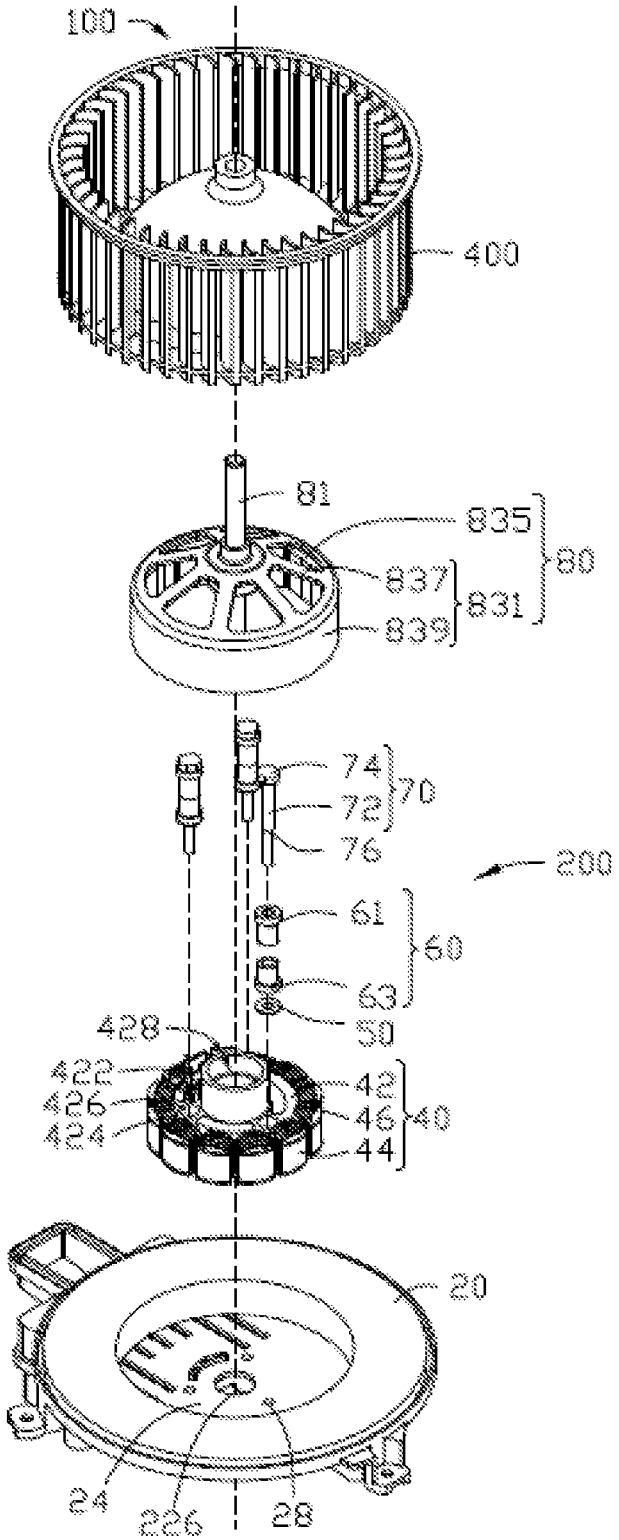
FIG. 2 is a perspective, exploded view of the fluid delivery device shown in FIG. 1.
Figure 3:
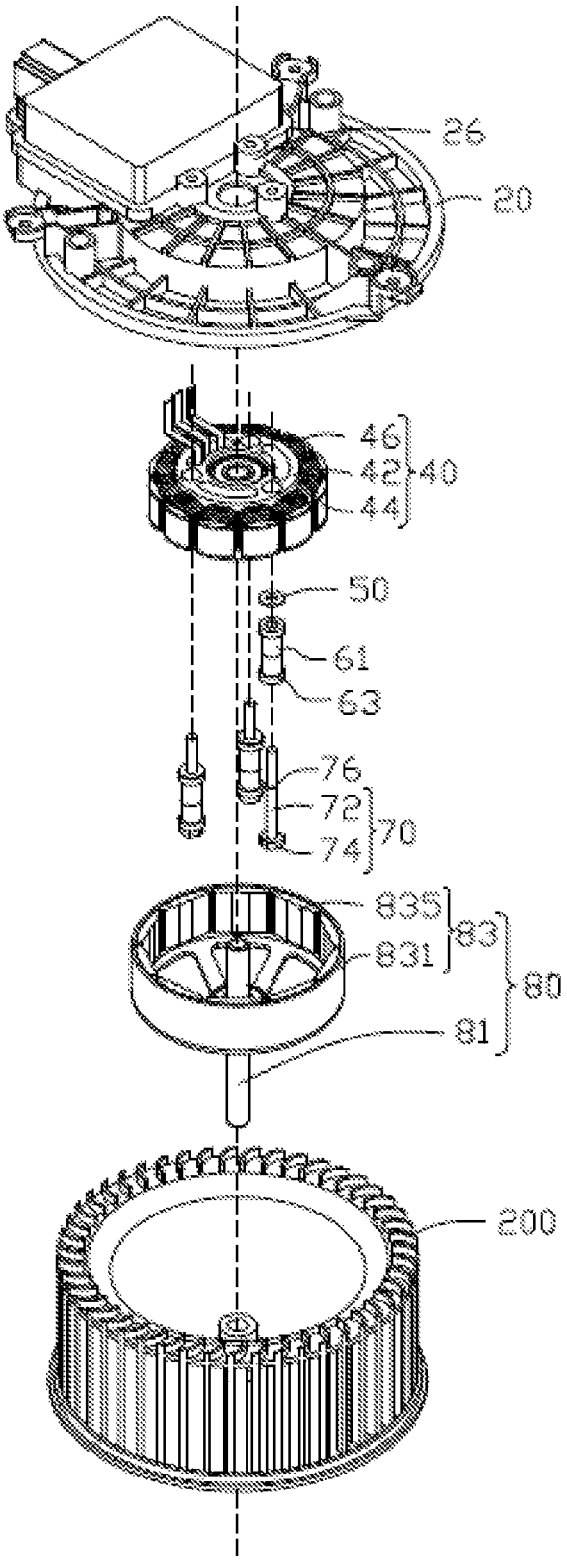
FIG. 3 is a perspective, exploded view of the fluid delivery device shown in FIG. 1, viewed from another aspect.

In this embodiment, the motor 200 is an outer-rotor motor. Referring also to FIG. 2 and FIG. 3, the motor 200 includes a housing 20, a stator 40, a washer 50, a shock absorbing member 60, a fastener 70 and a rotor 80. Specifically, in the illustrated embodiment, the stator 40 is disposed on the housing 20, the washer 50 is disposed between the stator 40 and the housing 20, the shock absorbing member 60 is received in the stator 40, the fastener 70 extends through the shock absorbing member 60, the washer 50 and the housing 20 to fixedly connect to the housing 20, and the rotor 80 is rotatably supported on the stator 40. It should be understood that the motor 200 may alternatively be an inner-rotor motor.

Figure 4:
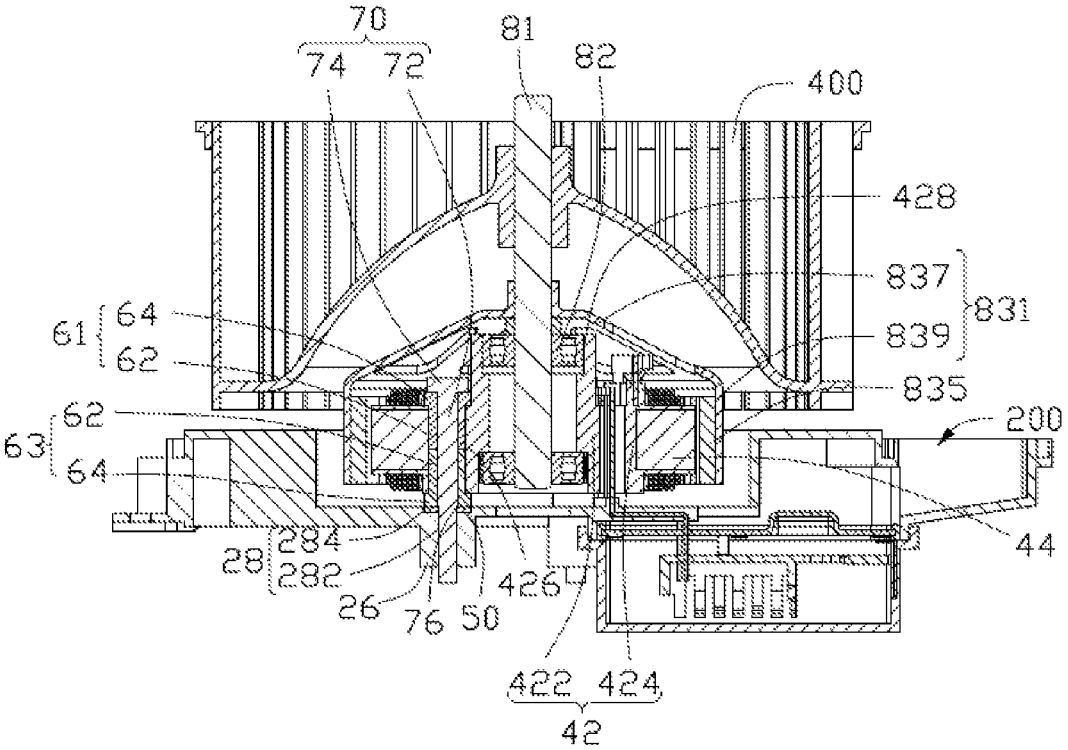
FIG. 4 is a sectional view of the fluid delivery device shown in FIG. 1.

In this embodiment, a depression 24 is defined in one side of the housing 20. A through hole 226 is defined in an approximate central area of a bottom portion of the depression 24. A mounting hole 28 is defined in the bottom portion of the depression 24 and is spaced from the through hole 226. Referring to FIG. 4, the mounting hole 28 is a step hole, which includes a first mounting portion 282 and a second mounting portion 284 in communication with the first mounting portion 282. The first mounting portion 282 has a diameter less than that of the second mounting portion 284. A support post 26 protrudes from an opposite side of the housing 20 and corresponds to the mounting hole 28, and the mounting hole 28 extends through the support post 26.

Referring also to FIG. 2, the stator 40 is received in the depression 24. In this embodiment, the stator 40 includes a bobbin 42 and a stator core 44 mounted on the bobbin 42. It should be understood that the stator 40 further includes windings 46, which are mounted to the stator core 44. Upon the windings 46 being energized, the rotor 80 is driven to rotate under an electromagnetic action. The bobbin 42 includes a central positioning portion 422 and a supporting portion 424 fixedly disposed around the central positioning portion 422. An accommodating portion 426 is defined in the supporting portion 424, corresponding to the mounting hole 28. In this embodiment, the accommodating portion 426 is a through hole that extends through the supporting portion 424. A connection hole 428 is defined through the central positioning portion 422.

The washer 50 is substantially of a circular ring shape, which is received in the second mounting portion 284 of the mounting hole 28 for engaging with the fastener 70. The washer 50 is located below the stator 40. In this embodiment, the washer 50 is made of metal. In other embodiments, the washer 50 may be made of other materials such as plastic. The shape of the washer 50 is not limited to the circular ring shape; rather, the washer 50 may be in another shape, for example, in the shape of a rectangular sheet with a through hole defined therethrough.

The shock absorbing member 60 is received in the accommodating portion 426. The shock absorbing member 60 includes a first shock absorbing body 61 and a second shock absorbing body 63 which are formed separately from each other. Referring to FIG. 4, the first shock absorbing body 61 and the second shock absorbing body 63 have substantially the same structure, and each includes a main portion 62 and a flange portion 64 protruding from a periphery of one end of the main portion 62. The main portion 62 is substantially cylinder-shaped. The main portion 62 of the first shock absorbing body 61 extends into one end of the accommodating portion 426 adjacent the impeller 400, and the flange portion 64 of the first shock absorbing body 61 is located outside of the accommodating portion 426 adjacent the impeller 400. The main portion 62 of the second shock absorbing body 63 extends into one end of the accommodating portion 426 adjacent the washer 50, and the flange portion 64 of the second shock absorbing body 63 is located outside of the accommodating portion 426 and fits the washer 50. Lateral surfaces of the main portion 62 of the first shock absorbing body 61 and the main portion 62 of the second shock absorbing body 63 fit an inner surface of the accommodating portion 426.

The flange portion 64 of the first shock absorbing body 61 is sandwiched between the bobbin 42 and the washer 50. The supporting portion 424 is sandwiched between the flange portion 64 of the first shock absorbing body 61 and the flange portion 64 of the second shock absorbing body 63. The flange portion 64 of the first shock absorbing body 61 and the flange portion 64 of the second shock absorbing body 63 fit opposite axial end surfaces of the supporting portion 424, respectively. In this embodiment, the shock absorbing member 60 is made of rubber. In other embodiments, the shock absorbing member 60 may be a component which is made of foam, resin, or plastic and is capable of absorbing shocks, and the shock absorbing member 60 may be an elastic iron plate or spring. The washer 50 is disposed between the flange portion 64 of the first shock absorbing body 61 and the housing 20.

The fastener 70 sequentially extends through the first shock absorbing body 61, the second shock absorbing body 63, the washer 50 and the second mounting portion 284, so as to fixedly connect the bobbin 42 to the housing 20. The fastener 70 includes a rod body 72 and a fastening head 74 protruding from one end of the rod body 72. The fastening head 74 has a diameter greater than that of the rod body 72. A shaft shoulder 76 is provide on the rod body 72. In this embodiment, the rod body 72 is formed by connecting two rods of different diameters, and the shaft shoulder 76 is formed between the two rods of different diameters. The rod body 72 extends through the shock absorbing member 60, the washer 50 and the second mounting portion 284, thereby fixedly connecting the bobbin 42 to the housing 20. The washer 50 abuts against the shaft shoulder 76 to limit a compression force applied to the shock absorbing member 60, thereby preventing the shock absorbing member 60 from being over-compressed by the fastening head 74 of the fastener 70 to affect service life of the shock absorbing member 60. The flange portion 64 of the second shock absorbing body 63 is sandwiched between the fastening head 74 and the supporting portion 424.

In this embodiment, there are three mounting holes 28, three accommodating portions 426, three support posts 26, three fasteners 70, three washers 50, and three shock absorbing members 60. The mounting holes 28 are disposed in the bottom portion of the depression 24 around the through hole 226. The accommodating portions 426 are disposed corresponding to the mounting holes 28. Each washer 50 is received in one corresponding mounting hole 28. Each shock absorbing member 60 extends through one corresponding accommodating portion 426. Each fastener 70 sequentially extends through one corresponding shock absorbing member 60, one corresponding washer 50 and one corresponding mounting hole 28, so as to fixedly connect the stator 40 to the housing 20. It should be understood that the number of the fasteners 70 is not limited to three, but instead may be one, two, four, five or more.

In this embodiment, the rotor 80 includes a main shaft 81 and a rotor assembly 83. The main shaft 81 is rotatably supported on the central positioning portion 422 via two bearings 82 (as shown in FIG. 4). The two bearings 82 are disposed in the central positioning portion 422 adjacent two ends of the central positioning portion 422, respectively. One end of the main shaft 81 extends outside of the first supporting portion 422 to non-rotatably connect to the impeller 400.

The rotor assembly 83 includes a casing 831 and a plurality of magnets 835 mounted to the casing 831. The casing 831 is disposed around the main shaft 81 and the stator 40, and the casing 831 is non-rotatably connected to the main shaft 81. In this embodiment, the casing 831 includes a first connection portion 837 and a second connection portion 839 connected with the first connection portion 837. The first connection portion 837 is substantially of a cambered shape, which is fixedly disposed around the main shaft 81 above the stator 40. The second connection portion 839 is disposed around the stator core 44. The magnets 835 are mounted to an inner surface of the second connection portion 839 and are spaced from the stator core 44, such that a clearance is always kept between the rotor assembly 83 and the stator core 44, thereby preventing the rotor assembly 83 from contacting the stator core 44.

The impeller 40 is non-rotatably connected to the end of the main shaft extending outside of the first connection portion 837. In this embodiment, the impeller 400 covers the first connection portion 837.

In assembly of the fluid delivery device 100 of this embodiment, the washers 50 are first received in the mounting holes 28, the shock absorbing members 60 are mounted to the stator 40, the stator 40 is placed in the depression 24 of the housing 20, the fasteners 70 are extended through the shock absorbing members 60, the washers 50 and the housing 20, thereby fixedly connecting the stator 40 to the housing 20. Next, the main shaft 81 is rotatably mounted to the bobbin 42, with one end of the main shaft 81 received in the bobbin 42, and the other end thereof extending outside of the bobbin 42. The rotor assembly 83 is then disposed around the main shaft 81 and the stator 40, and the rotor assembly 83 is non-rotatably connected to the main shaft 81. Finally, the impeller 400 is mounted to one end of the main shaft 81 away from the bobbin 42. When the fluid delivery device 100 of this embodiment is used, the rotor 80 rotates to drive the main shaft 81 and the impeller 400 to rotate.

Vibrations generated by rotation of the motor 200 are partially absorbed by the shock absorbing member 60, and partially transmitted via the fasteners 70 to the housing 20 and hence to be absorbed by the housing 20. As a result, the vibrations caused by the motor 200 are reduced.

It should be understood that, in other embodiments, the motor 200 of the present invention may also be used in other fluid delivery devices such as water pumps. It should be understood that, in other embodiments, the motor 200 may be an inner-rotor motor.

In the motor 200 of the present invention, the shock absorbing members 60 are disposed in the stator 40, the fasteners 70 extend in the shock absorbing members 60, so that the vibrations generated by rotation of the motor 200 are partially absorbed by the shock absorbing members 60, and partially transmitted via the fastener 70 to the housing 20 and hence to be absorbed by the housing 20, thereby reducing the noise generated by the motor 200. In addition, the fasteners 70 are provided with the shaft shoulders 76 and the washers 50 abut against the shaft shoulders 76 to limit a compression force applied to the shock absorbing members 60, thereby preventing the shock absorbing members 60 from being over-compressed by the fastening heads 74 of the fasteners 70 to affect service life of the shock absorbing members 60.

It should be understood that, the shock absorbing members 60 may be disposed between the stator 40 and the housing 20, instead of being received in the accommodating portions 426. In this case, the fasteners 70 sequentially extend through the accommodating portions 426 and the shock absorbing members 60 to fixedly connect to the housing 20. The shock absorbing member 60 may not be received in the accommodating portions 426, but instead may be disposed at one side of the stator 40 adjacent the first connection portion 837, and the fasteners 70 sequentially extend through shock absorbing members 60 and the accommodating portions 426 to fixedly connect to the housing 20. As such, the shock absorbing members 60 can still absorb the vibrations generated by the motor 200, and the fasteners 70 can transmit the vibrations to the housing 20 so as to be received by the housing 20, thereby reducing the noise generated by the motor 200.

It should be understood that the two flange portions 64 may be omitted from each shock absorbing member 60.

It should be understood that the motor 200 may omit the washers 50, the mounting holes 28 may be omitted, and the fasteners 70 may be directly fixedly connected to the housing 20.

It should be understood that the depression in the housing 20 may be omitted, and the stator 40 is directly disposed on the housing 20.

It should be understood that the fastening heads 74 of the fasteners 70 may be omitted, and a cross section of the rod body 72 is uniform over the entire length of the rod body 72. Alternatively, the cross section of the rod body 72 may also be non-uniform over the entire length of the rod body 72, as long as the fasteners 70 can extend through the shock absorbing members 60 to be fixedly connected to the housing 20. The shaft shoulder 76 may be a projection formed on the rod body 72.

It should be understood that the shock absorbing member 60 may be integrally formed, that is, one end of the main portion 62 of the first shock absorbing body 61 away from the flange portion 64 of the first shock absorbing body 61 is integrally formed with one end of the main portion 62 of the second shock absorbing body 63 away from the flange portion 64 of the second shock absorbing body 63. The stator core 44 may be detachably connected with the bobbin 42. The accommodating portion 426 may be configured as a U-shaped groove extending through the central positioning portion 422. In assembly, the shock absorbing member 60 is accommodated in the accommodating portion 426, and then the stator 44 is disposed around the bobbin 42. Since the accommodating portion 426 is configured as the U-shaped groove extending through the central positioning portion 422, and the stator core 44 is detachably connected with the bobbin 42, mounting of the integral shock absorbing member 60 is facilitated.

It should be understood that the shock absorbing member 60 may be integrally formed and, in assembly, the shock absorbing member 60 extends through and is compressed within the accommodating portion 426 by means of its own elastic deformation.

Figure 5:
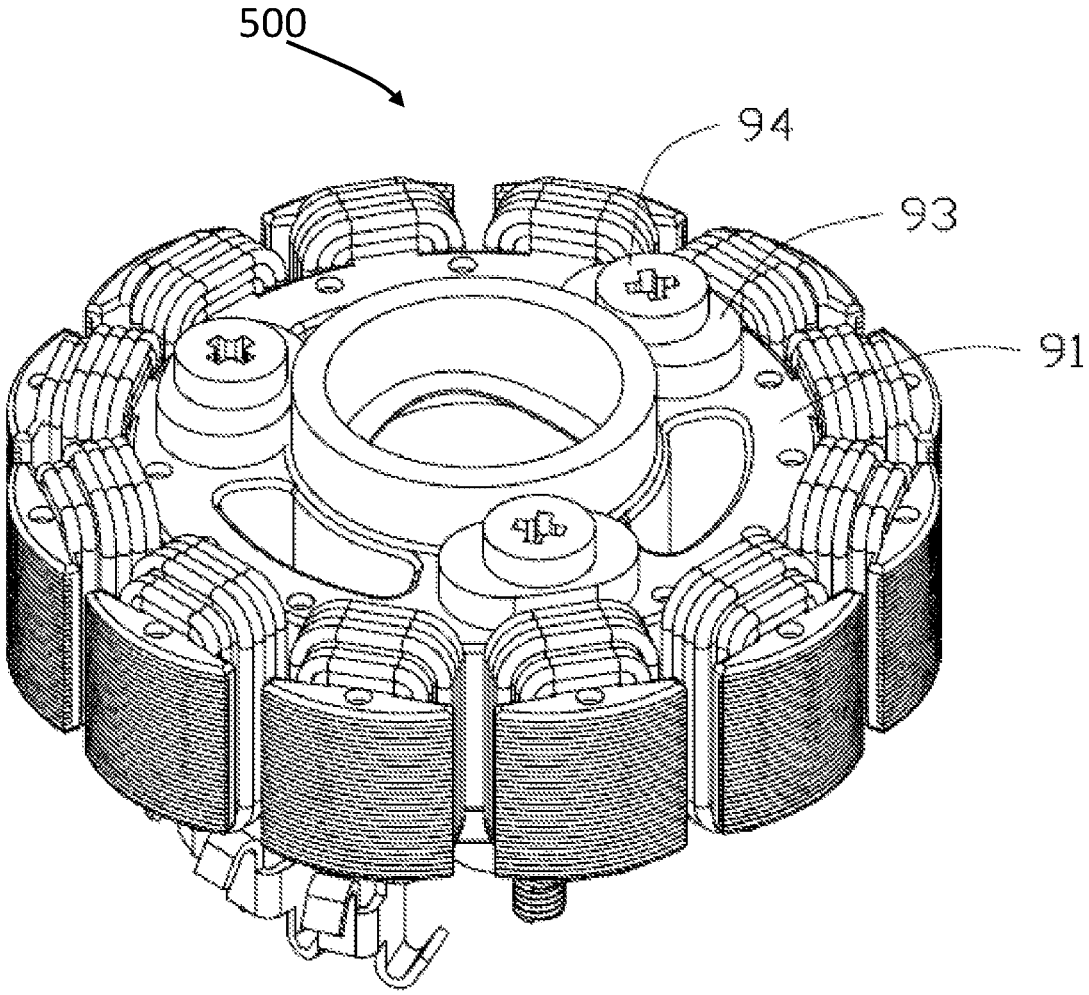
FIG. 5 is a perspective view of a partial structure of a fluid delivery device according to a second embodiment of the present invention.
Figure 6:
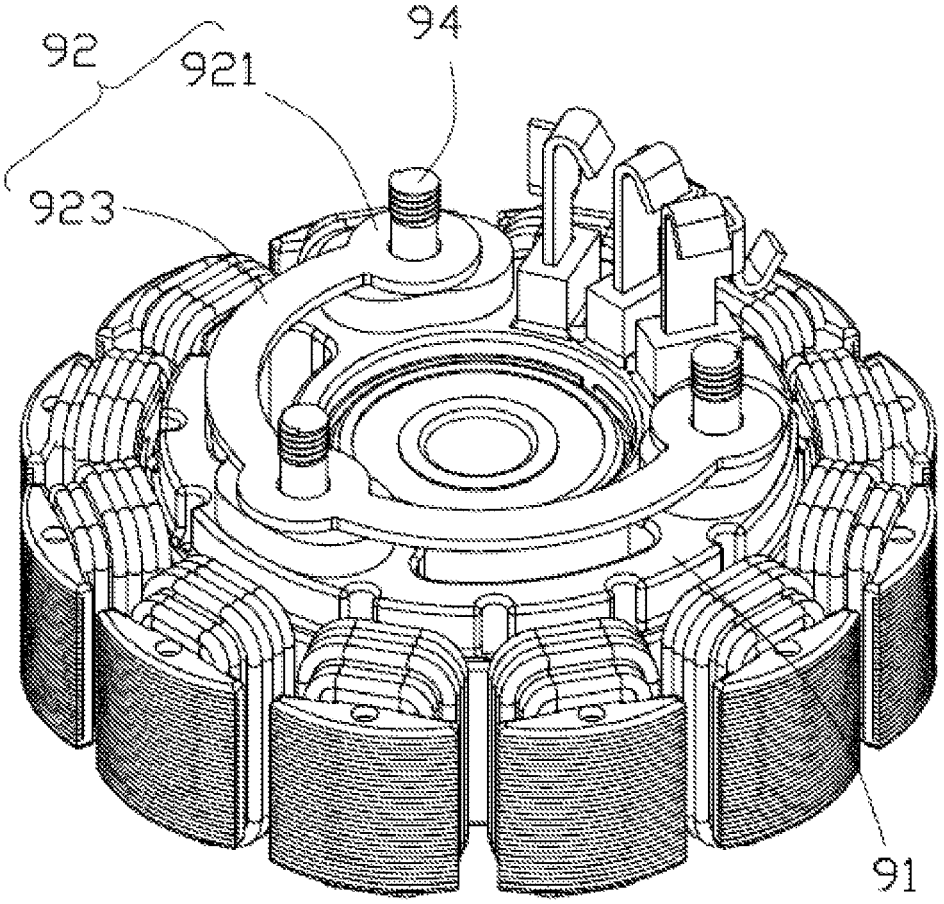
FIG. 6 is a perspective view of the fluid delivery device shown in FIG. 5, viewed from another aspect.
Figure 7:
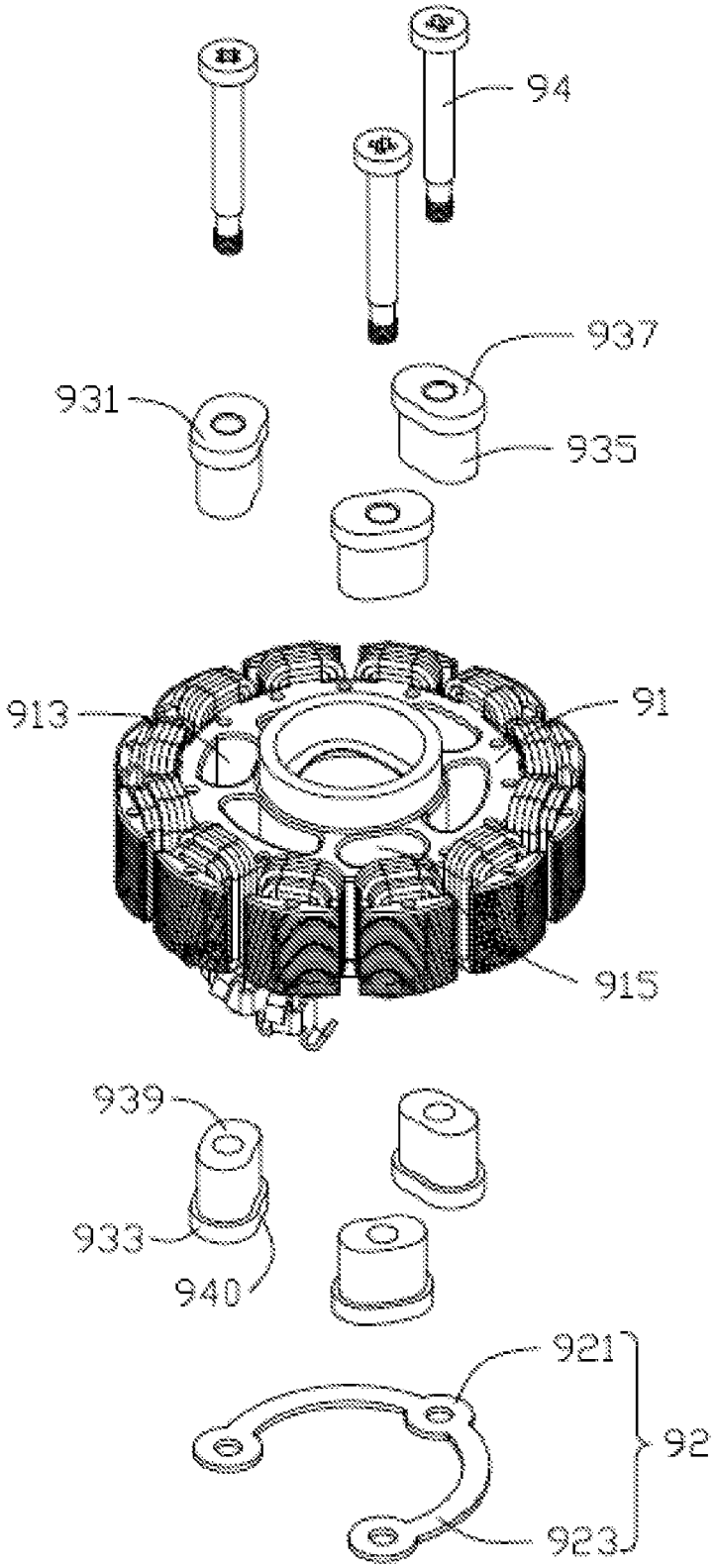
FIG. 7 is a perspective, exploded view of the fluid delivery device shown in FIG. 5.

FIG. 5 and FIG. 6 are schematic views of partial structures of a fluid delivery device 500 according to a second embodiment of the present invention. The fluid delivery device 500 is substantially the same as the fluid delivery device 100 of the first embodiment of the present invention, except for the partial structures of a bobbin 91, a washer 92 and shock absorbing members 93. Referring also to FIG. 7, three accommodating portions 913 are disposed in the bobbin 91 at intervals. A first guiding portion 915 is provided on an inner surface of each accommodating portion 913. The washer 92 is substantially C-shaped, which includes three position-limiting portions 921 and two fixed connection portions 923, with one fixed connection portion 923 connecting two adjacent position-limiting portions 921. The fixed connection portion 923 is substantially of an arc shape. The washer 92 is disposed on a housing (not shown), and the position-limiting portions 921 are disposed corresponding to the accommodating portions 913. Each shock absorbing member 93 includes a first shock absorbing body 931 and a second shock absorbing body 933 which are formed separately from each other. The first shock absorbing body 931 and the second shock absorbing body 933 have substantially the same structure, and each includes a main portion 935 and a flange portion 937 protruding from a periphery of one end of the main portion 935. A second guiding portion 939 is provided on the main portion 935 for engaging with the first guiding portion 915. A recessed portion 940 is formed on the flange portion 937, and the recessed portion 940 and the second guiding portion 939 are located at a same side of the flange portion 937, so as to facilitate correct insertion of the first shock absorbing body 931 or the second shock absorbing body 933 during assembly. In this embodiment, the first guiding portion 915 at the inner surface of the accommodating portion 913 is a protruding portion, the second guiding portion 939 of the main portion 935 is a recessed portion, and the first guiding portion 915 is accommodated in the second guiding portion 939. When the main portion 935 is inserted into the accommodating portion 913, the main portion 935 moves along the first guiding portion 915, thereby facilitating the assembling. The fastener 94 sequentially extends through the first shock absorbing body 931, the second shock absorbing body 933 and the position-limiting portion 921.

It should be understood that the washer 92 may be of other shapes such as in the form of a circular disc having position-limiting portions 921, the number of which is equal to the number of the shock absorbing members 93.

The above embodiments are merely to illustrate the technical solutions of the present invention and are not intended to limit the present invention. Although the present invention has been described with reference to the above preferred embodiments, it should be appreciated by those skilled in the art that various modifications and variations may be made without departing from the spirit and scope of the present invention.

The invention claimed is:

1. A motor comprising:

a housing;

a stator disposed in the housing;

a rotor rotatably supported on the stator;

at least one fastener extending through the stator and fastened to the housing, and at least one shock absorbing member mounted to the stator and engaged between the fastener and the stator, thereby preventing the fastener from directly contacting the stator, wherein the fastener comprises a rod body and a fastening head protruding from one end of the rod body, the rod body extends through the shock absorbing member and the stator to be fixedly connected to the housing, and the fastening head is disposed adjacent one end of the shock absorbing member away from the housing, and wherein the motor further comprises a C-shaped washer, the washer is disposed between the shock absorbing member and the housing, a shaft shoulder is provided on the rod body, the rod body extends through the washer, and the washer abuts against the shaft shoulder, said at least one shock absorbing member comprises two or more shock absorbing members, said at least one fastener comprises two or more fasteners, the number of the fasteners is equal to the number of the shock absorbing members, the washer comprises two or more position-limiting portions, the number of the position-limiting portions is equal to the number of the shock absorbing members, and each fastener extends through one of the position-limiting portions.

2. The motor of claim 1, wherein an accommodating portion is defined in the stator, and the shock absorbing member is received in the accommodating portion, the fastener extending through the shock absorbing member.

3. The motor of claim 2, wherein the shock absorbing member comprises a first shock absorbing body and a second shock absorbing body, the first shock absorbing body and the second absorbing body are configured to be engaged into the accommodating portion from opposite ends of the accommodating portion.

4. The motor of claim 3, wherein the first shock absorbing body comprises a main portion and a flange portion formed at an end of the main portion, the main portion of the first shock absorbing body are engaged in the accommodating portion, the flange portion of the first shock absorbing body extends out of the accommodating portion, the fastener extends through the flange portion of the first shock absorbing body and the main portion of the first shock absorbing body.

5. The motor of claim 4, wherein the second shock absorbing body comprises a main portion and a flange portion formed at an end of the main portion, the main portion of the second shock absorbing body are engaged in the accommodating portion, the flange portion of the second shock absorbing body extends out of the accommodating portion, and the stator is sandwiched between the flange portion of the first shock absorbing body and the flange portion of the second shock absorbing body, the fastener extends through the flange portion of the second shock absorbing body and the main portion of the second shock absorbing body.

6. The motor of claim 3, wherein the first shock absorbing body and the second shock absorbing body are integrally formed or separately formed.

7. The motor of claim 2, wherein the stator comprises a bobbin and a stator core supported by the bobbin, the accommodating portion is a through hole defined in the bobbin.

8. The motor of claim 2, wherein the stator comprises a bobbin and a stator core detachably mounted to the bobbin, the accommodating portion is a groove extending through the bobbin adjacent a lateral surface of the stator core.

9. The motor of claim 7, wherein the bobbin comprises a central positioning portion and a supporting portion fixedly attached around the central positioning portion, the stator core is fixed by the supporting portion and the accommodating portion is defined in the supporting portion.

10. The motor of claim 9, wherein the rotor comprises a main shaft and a rotor assembly, the main shaft is rotatably supported on the supporting portion, the rotor assembly is fixedly sleeved on the main shaft and rotatably disposed around the stator core with a clearance kept between the inner surface of the rotor assembly and the stator core.

11. The motor of claim 10, wherein the rotor assembly comprises a casing and a plurality of magnets mounted to the casing, the casing comprises a first connection portion and a second connection portion connected with the first connection portion, the magnets are mounted to an inner surface of the second connection portion, the first connection portion is fixedly attached around the main shaft above the stator, and the second connection portion is disposed around the stator core.

12. The motor of claim 2, wherein a first guiding portion is formed on an inner surface of the accommodating portion, a second guiding portion is provided on a lateral surface of the shock absorbing member, configured to mate with the first guiding portion.

13. The motor of claim 2, wherein a lateral surface of the shock absorbing member fits an inner surface of the accommodating portion.

14. The motor of claim 1, wherein a depression is defined in one side of the housing, the stator and the rotor are received in the depression, and a mounting hole is defined in a bottom portion of the depression.

15. The motor of claim 14, wherein the housing further comprises a support post, the support post protrudes from an opposite side of the housing and corresponds to the mounting hole, and the mounting hole extends through the support post.

16. The motor of claim 1, wherein the washer further comprises fixed connection portions, and each of the fixed connection portions connect two adjacent position-limiting portions.

17. The motor of claim 1, wherein the shock absorbing member is made of one of rubber, resin and foam.

18. A fluid delivery device comprising:

an impeller; and a motor comprising:

a housing;

a stator disposed in the housing;

a rotor rotatably supported on the stator and fixedly connected to the impeller;

at least one fastener extending through the stator and fastened to the housing, and at least one shock absorbing member mounted to the stator and engaged between the fastener and the stator, thereby present the fastener from directly contacting the stator, wherein the fastener comprises a rod body and a fastening head protruding from one end of the rod body, the rod body extends through the shock absorbing member and the stator to be fixedly connected to the housing, and the fastening head is disposed adjacent one end of the shock absorbing member away from the housing, and wherein the motor further comprises a C-shaped washer, the washer is disposed between the shock absorbing member and the housing, a shaft shoulder is provided on the rod body, the rod body extends through the washer, and the washer abuts against the shaft shoulder, said at least one shock absorbing member comprises two or more shock absorbing members, said at least one fastener comprises two or more fasteners, the number of the fasteners is equal to the number of the shock absorbing members, the washer comprises two or more position-limiting portions, the number of the position-limiting portions is equal to the number of the shock absorbing members, and each fastener extends through one of the position-limiting portions.

* * * * *